US007165915B2

(12) United States Patent
Queen

(10) Patent No.: US 7,165,915 B2
(45) Date of Patent: Jan. 23, 2007

(54) HIGH CAPACITY LOW PROFILE SLAB FOUNDATION STABILIZING APPARATUS

(76) Inventor: Frankie A. R. Queen, 8408 Tivoli Dr., Orlando, FL (US) 32836

( * ) Notice: Subject to any disclaimer, the term of this patent is extended or adjusted under 35 U.S.C. 154(b) by 0 days.

(21) Appl. No.: 11/114,531

(22) Filed: Apr. 26, 2005

(65) Prior Publication Data

US 2005/0238442 A1 Oct. 27, 2005

Related U.S. Application Data

(60) Provisional application No. 60/565,682, filed on Apr. 27, 2004.

(51) Int. Cl.
*E02D 27/50* (2006.01)
*E02D 5/74* (2006.01)

(52) U.S. Cl. ..... 405/244; 405/232

(58) Field of Classification Search ..... 405/230, 405/232, 244

See application file for complete search history.

(56) References Cited

U.S. PATENT DOCUMENTS 5,120,163 A 6/1992 Holdeman et al. ..... 405/230

5,213,448 A 5/1993 Seider et al. ..... 405/230

OTHER PUBLICATIONS

"Helical Pier Foundation System," Technical Manual, A. B. Chance Co., Bulletin 01-9601, Rev. Jul. 1996.

"Helical Pier Foundation Systems," Technical Manual, A. B. Chance Co., Bulletin 01-9601, Revised Oct. 2002.

"Helical Pier Foundation Systems," A Solid Foundation Solution for Homeowners, A. B. Chance, Bulletin 01-9501, Revised Jan. 2004.

"Helical Pier Foundation Systems and Instant Foundation System," A.B. Chance Co., 3M-RGS-Jul. 1999.

*Primary Examiner*—Thomas B. Will
*Assistant Examiner*—Tara L. Mayo
(74) *Attorney, Agent, or Firm*—Thomas, Kayden, Horstemeyer & Risley, LLP

(57) ABSTRACT

The foundation stabilizer includes a bearing plate (31) that is mounted in a stationary position on the upper end of a ground anchor (20). A foundation lifting bracket (28) is positioned below the bearing plate (31) and lifting screws (57, 58) are connected at their lower ends to the foundation lifting bracket (28) and extend upwardly through openings in the bearing plate (31) for lifting the foundation lifting bracket with a jack (63) temporarily mounted on the bearing plate. The foundation lifting bracket (28) is configured so that it does not exceed the height of the bearing plate (31) when it is raised by the lifting screws (57, 58).

6 Claims, 5 Drawing Sheets

HIGH CAPACITY LOW PROFILE SLAB FOUNDATION STABILIZING APPARATUS

CROSS REFERENCE TO RELATED APPLICATION

This application claims the benefit of U.S. Provisional Application Ser. No. 60/565,682 filed Apr. 27, 2004, which is incorporated herein by reference.

FIELD OF THE INVENTION

This invention concerns a method and apparatus for stabilizing and supporting a structural foundation of a building structure that has or is likely to experience settlement or movement, and more particularly to a method and apparatus for elevating and/or providing stabilization to a slab or turn-down slab foundation from further settlement.

BACKGROUND OF THE INVENTION

Foundations for buildings and other structures that have settled in the earth after initial construction tend to cause movement of the building structure, deterioration to the building structure, and might require a lifting force to stabilize the building structure. The cause for foundations settling or sinking can be from many sources, such as shifting soils resulting from acts of God or from earth excavation by man, faulty foundation design, water drainage from rain, broken water pipes or other water sources that cause erosion, or just by poor initial construction practices. Resolving and correcting the building settlement problems can be costly to the building owner.

Slab or turn-down slab foundations are installed in certain geographical areas in order to take advantage of the support bearing characteristics of the underlying soils, or as a cheaper, more economical means of supporting a structure over other conventional means of foundation construction practices.

Some turn-down slab foundations that have experienced settlement can be stabilized by installing grout under pressure beneath the slab in order to raise or stabilize the slab when underpinning practices that are currently utilized do not provide proper stabilization for the slab. The grouting of a slab is occasionally a costly form of remediation and usually is not an exacting method of correcting the problem. Grouting with a cementitious material is sometimes unreliable in attempting to correct the settlement problem and, in some cases, can cause additional problems.

For example, grouting is sometimes considered as only a temporary fix, even when the application of grout has properly stabilized the structural slab. There still might be some likelihood of continued erosion and/or shifting of the earth, including the shifting about the grout installed beneath the slab. This tends to allow continued movement of the slab. Also, it usually is not practical to determine if all the voids beneath the slab are properly filled with grout. In some instances, the grout that is placed beneath the structural slab is more dense than the soil and tends to sink within the soil. Moreover, the insertion of grout can damage the structural slab by inadvertently lifting the slab due to the excess pressure of the grout applied by the grout pump. In addition, the application of grout is costly and the grout is likely to follow the paths of least resistance that may not be effective in raising the foundation slab.

In contrast to the stabilizing of a foundation slab with grout, mechanical jack devices can be used for stabilizing the slabs. Ground anchors are inserted in the ground about the portion of the slab to be stabilized so as to function as piles, and foundation-lifting brackets are mounted on the piles and are applied to slab. Jacks are used to raise the foundation lifting brackets with respect to the piles, resulting in applied lifting force to the slab. This keeps the excavation at the slab to a minimum and potentially out of the water table, holds a designed load in a specific soil, and has been proven in field tests to be more rigid, stable and predictable than the use of grout.

Examples of such slab stabilization devices are described in U.S. Pat. Nos. 5,120,163; and 5,213,448.

One of the problems with the prior art mechanical slab stabilization devices is that after the slab has been stabilized the components of the stabilization devices usually protrude above the slab at the edge of the building structure. There is a need to keep the top of the foundation-lifting bracket and its associated components that are mounted to the slab at a level lower than the upper surface of the slab, without sacrificing the strength of the foundation-lifting bracket and its related components. This lower profile arrangement avoids the objectionable upward protrusion of components of the devices that would be obnoxious to the visual appearance of the building structure and would avoid the possible reduced value of the building structure. By reducing the height of the foundation-lifting bracket and its associated components, they can be covered over with earth and become invisible.

As described in the above noted patents, prior art devices used for stabilizing structural foundations of buildings utilize hydraulic jacks that rest upon the power installed pile and lift an assembly of brackets that are connected downwardly to the foundation pile, thereby lifting the bracket and the foundation supported by the bracket. Once the foundation has been lifted to the desired position, the screws of the lifting apparatus are fixed in place and the jack and its associated components are removed from the structure. While this removes the jack and its components from sight, the prior art foundation-lifting bracket has permanent components that still extend too high about the foundation of the building structure.

In some instances, the operators of this type foundation-lifting apparatus have use shims placed on the lifting brackets to achieve the desired lift of the foundation but avoid having the apparatus protrude above grade. However, the addition of shims to the lifting brackets is undesirable since proper sized shims are not readily available and thew shims might shift during the lifting procedures or at a later time.

It is to this problem that this invention is addressed.

SUMMARY OF THE INVENTION

Briefly described, the present invention comprises an apparatus for stabilizing the structural foundation of a building of the type that has a concrete slab. The earth is excavated at the sides about the structural slab where the stabilization is required. Elongated ground anchors are placed in the excavations. The ground anchors each include a shaft with a lower end and an upper end, and an auger thread extends from the lower end and is used for screwing the anchor into the earth. The upper end of the shaft is exposed at the level of the earth. The upper end of thee shaft might be cut away for locating the shaft at the desired height. This forms a pile on which a foundation-lifting bracket can be mounted.

A jacking tool assembly is mounted to the upper end of the pile. The jacking tool assembly includes a mounting sleeve that telescopically mounts downwardly about the upper end of the exposed shaft of the pile that has been cut to grade, and a jack and pile bearing plate that is supported by the mounting sleeve. A foundation-lifting bracket is positioned about the mounting sleeve of the jacking tool assembly at a level below the jack platform. The foundation-lifting bracket includes an L-shaped foundation engaging plate having both laterally and upwardly extending flanges for engagement at the lower edge of the foundation slab. Parallel strengthening plates are mounted to the support flanges of the L-shaped foundation engaging plate and straddle the mounting sleeve of the jacking tool assembly, and a pair of inverted elevator brackets are mounted on opposite sides of the parallel strengthening plates. Each inverted elevator bracket is L-shaped with a laterally extending plate that defines a lifting screw opening. Lifting screws extend vertically through the lifting screw openings of the inverted elevator brackets and through aligned lifting screw openings of the jack and pile bearing plate, and connectors are mounted to the ends of the lifting screws. This functions to suspend the foundation-lifting bracket from the jacking tool assembly.

When the apparatus is installed at the edge of a structural foundation slab, the foundation-lifting bracket is positioned at the lower edge of the slab and a jack is placed on the jack and pile bearing plate and connected to the elevator screws. The jack is actuated to lift the elevator screws through the jacking tool assembly platform so that the foundation-lifting bracket moves upwardly, raising the foundation slab. Once the jack has properly lifted the foundation slab to a proper elevation, nuts are tightened between the elevator screws and the jack and pile bearing plate, thereby maintaining the foundation-lifting bracket in the desired position where it supports the foundation slab. The jack and its components are then removed from the structure, thereby lowering the profile of the structure. If desired, the upwardly protruding ends of the elevator screws can be removed by cutting them away from the lower structural components, thereby reducing the height of the overall structure, so that the structure does not protrude to a level as high as the upper horizontal surface of the structural slab.

A preferred embodiment of the invention includes the pair of inverted elevator brackets being mounted on opposite sides of the parallel strengthening plates, with each elevator bracket being L-shaped and forming with the parallel strengthening plates a U-shaped recess. This places the lifting screw openings of the inverted elevator brackets through the laterally extending bottom plate, so that the lower connectors of the lifting screws are located at the bottom side of the laterally extending bottom plates. Thus, the threads of the lifting screws are located as low as practical in the arrangement of the components of the foundation-lifting bracket, so that the foundation-supporting bracket has a large vertical amplitude of movement along the jacking tool assembly. As the foundation-lifting bracket is raised the structural slab moves up with respect to the jacking tool assembly. This tends to effectively lower the structural components of the foundation-stabilizing device with respect to the structural slab.

One of the ways to avoid having a high profile of the apparatus after it has been installed is to configure the parts so that the L-shaped foundation-supporting bracket so that the vertical flange does not rise to a level higher than the jack and pile bearing plate. For example, the vertical flange can be foreshortened so that it cannot reach upwardly beyond the bearing plate when the L-shaped foundation-supporting bracket reaches its highest position.

Thus, it is an object of this invention to provide an improved apparatus and method for stabilizing structural foundations of buildings that have adequate strength properties and are of such low profile as to avoid protrusion above the level of the slab being stabilized.

Another object of this invention is to provide an improved strength apparatus for stabilizing structural foundations of buildings wherein a jack can be mounted to the apparatus for lifting the slab and, once raised, the apparatus can be set to hold the slab in its raised position, and the jack removed so as to avoid the presence of upwardly extending components from the apparatus.

Another object of this invention is to provide an improved apparatus for stabilizing the structural foundation of a building that is easy to operate, inexpensive to construct, and which provides an improved appearance.

Other objects, features, and advantages of the present invention will become apparent upon reading the following specification, when taken in conjunction with the accompanying drawings.

DETAILED DESCRIPTION

Figure 1:
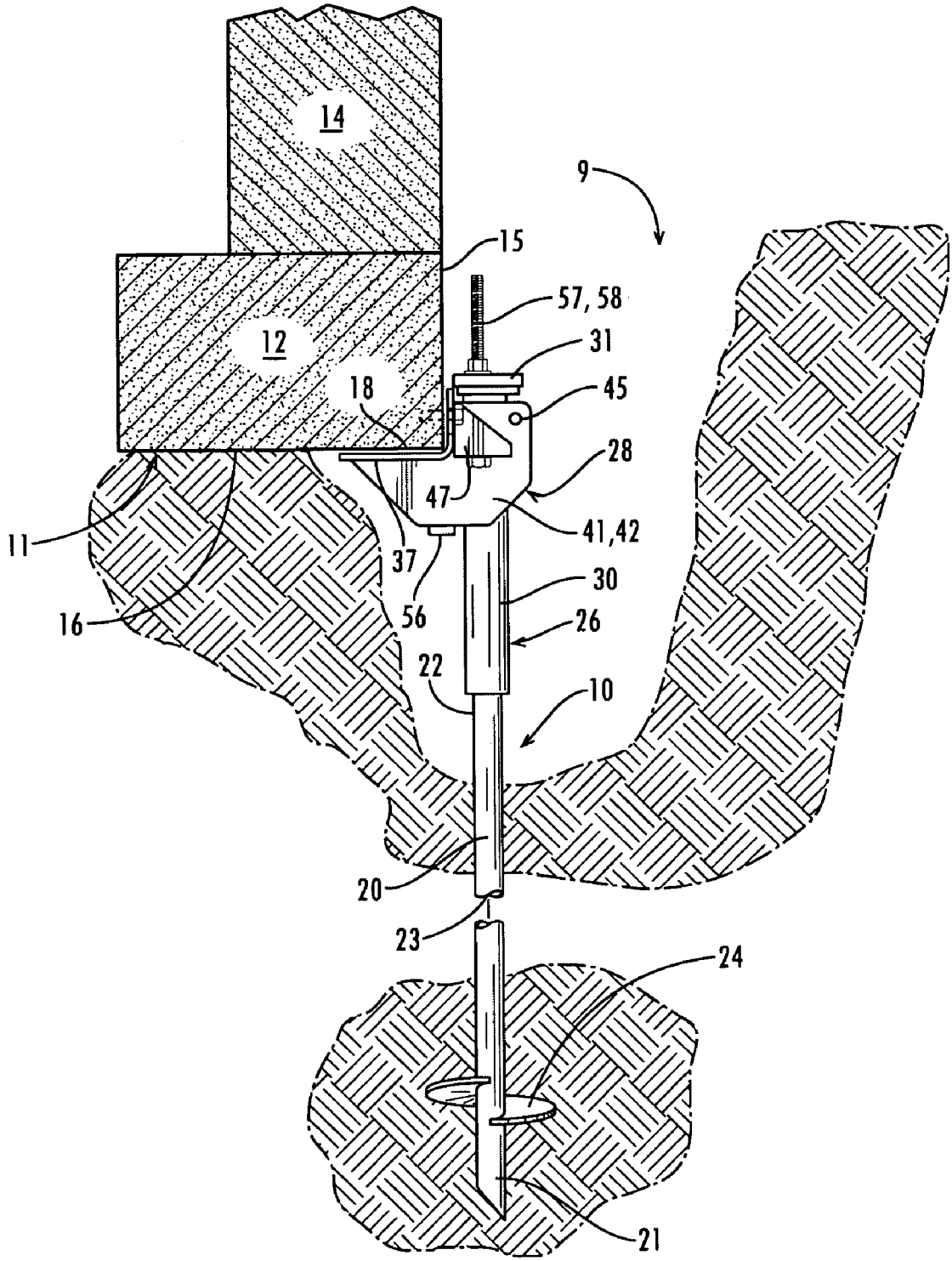
FIG. 1 is a side elevational view of the stabilizing apparatus for stabilizing the structural foundation of a building, showing the apparatus in engagement with the lower edge of a structural slab, and the helical plate load transfer component of the pile engaged within the soil.

Referring now in more detail to the drawings in which like numerals indicate like parts throughout the several views, FIG. 1 shows the high capacity low profile slab foundation stabilizing apparatus 10 that engages the structural foundation 11 of a building structure. The structural foundation 11 typically includes a horizontally extending slab 12 and a vertical wall 14 resting at the edge of the slab. In some slab structures the slab has a turned down edge that provides additional strength to the edge of the slab. The edge of the slab includes a vertical side surface 15 and a horizontal bottom surface 16. The side surface and bottom surface intersect at the corner 18 of the slab.

The stabilizer apparatus 10 includes a ground anchor 20 that has a shaft 23 having a lower end 21 and an upper end 22, and an auger blade 24 mounted to the lower end 21. The ground anchor 20 is driven into the ground adjacent the corner 18 of the horizontal slab 12, by rotating the shaft of the anchor so that the auger blade rotates and draws the ground anchor downwardly into the earth. Once the auger blade 24 reaches the proper depth in the earth, the upper portion of the shaft of the ground anchor can be cut to the proper desired height. In this way, the ground anchor functions as a pile for supporting the foundation stabilizing apparatus. There may be several similar piles spaced at intervals along the edge of a horizontal slab where the slab is in need of stabilization.

The foundation stabilizing apparatus further includes a jack and pile bearing plate support 26 that is mounted to the upper end of the ground anchor 20, and a foundation-lifting bracket 28 that is mounted to the jacking tool assembly in a manner described hereinafter. The foundation-lifting bracket engages the structural slab 11.

Figure 4:
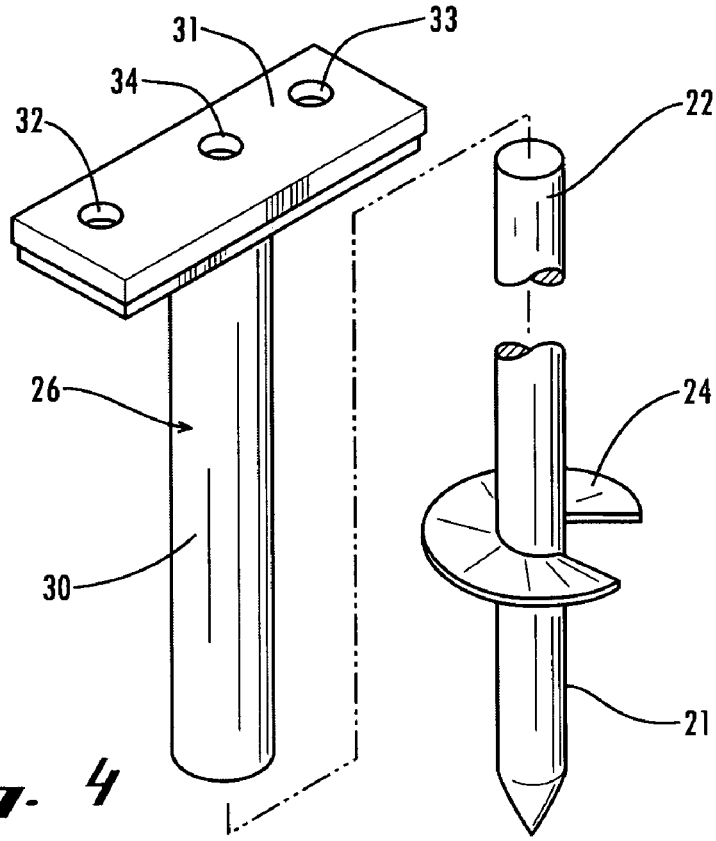
FIG. 4 is an expanded view of the lower and upper ends of an earth anchor that functions as a pile, and the bearing plate jack support and pile that is telescopically mounted on the upper end of the pile.

As shown in FIG. 4, the jacking tool assembly includes a mounting sleeve 30 that is open at its lower end and a jack and pile bearing plate 31 that is mounted to the upper end of the mounting sleeve 30, so that when the mounting sleeve is oriented vertically, the jack and pile bearing plate 31 is oriented horizontally, to form a T-shaped structure. Lifting screw openings 32 and 33 are formed vertically through the jack and pile bearing plate 31 and are spaced apart sufficiently to be outside the boundaries of the mounting sleeve 30. A hot dipped galvanization portal 34 is formed through the jack and pile bearing plate 31 and is coextensive with the opening that extends through the mounting sleeve 30. The mounting sleeve 30 is telescopically fitted to the upper end 22 of the shaft 23 of the ground anchor 20.

Figure 5:
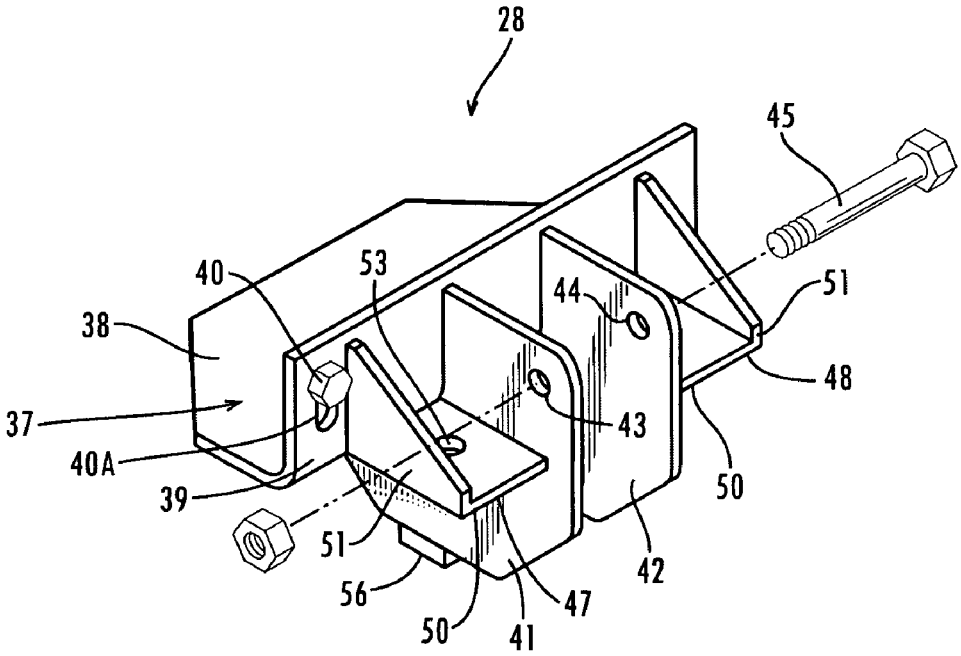
FIG. 5 is an expanded perspective view of the low profile foundation-lifting bracket, showing the keeper bolt aligned with the openings of the bracket.

As shown in FIG. 5, foundation-lifting bracket 28 includes L-shaped foundation engaging plate 37 that includes a laterally extending support flange 38 for extending beyond the corner 18 of the horizontal slab 12 for engaging the horizontal bottom surface 16 of the slab, and a foreshortened upwardly extending positioning flange 39 for engaging against the vertical side surface 15 of the structural slab 12. Anchor bolts 40 extend through oblong connector openings 40A to hold the foundation plate in position on the foundation slab. The oblong connector openings 40A have their long axes extending vertically so that the anchor bolts can be re-positioned if the screws inadvertently engage the rebar of the slab. The connector openings 40A are positioned beside the upwardly extending positioning flange 39 so as to avoid the upwardly extending positioning flange having extra height to accommodate the connector openings.

Figure 2:
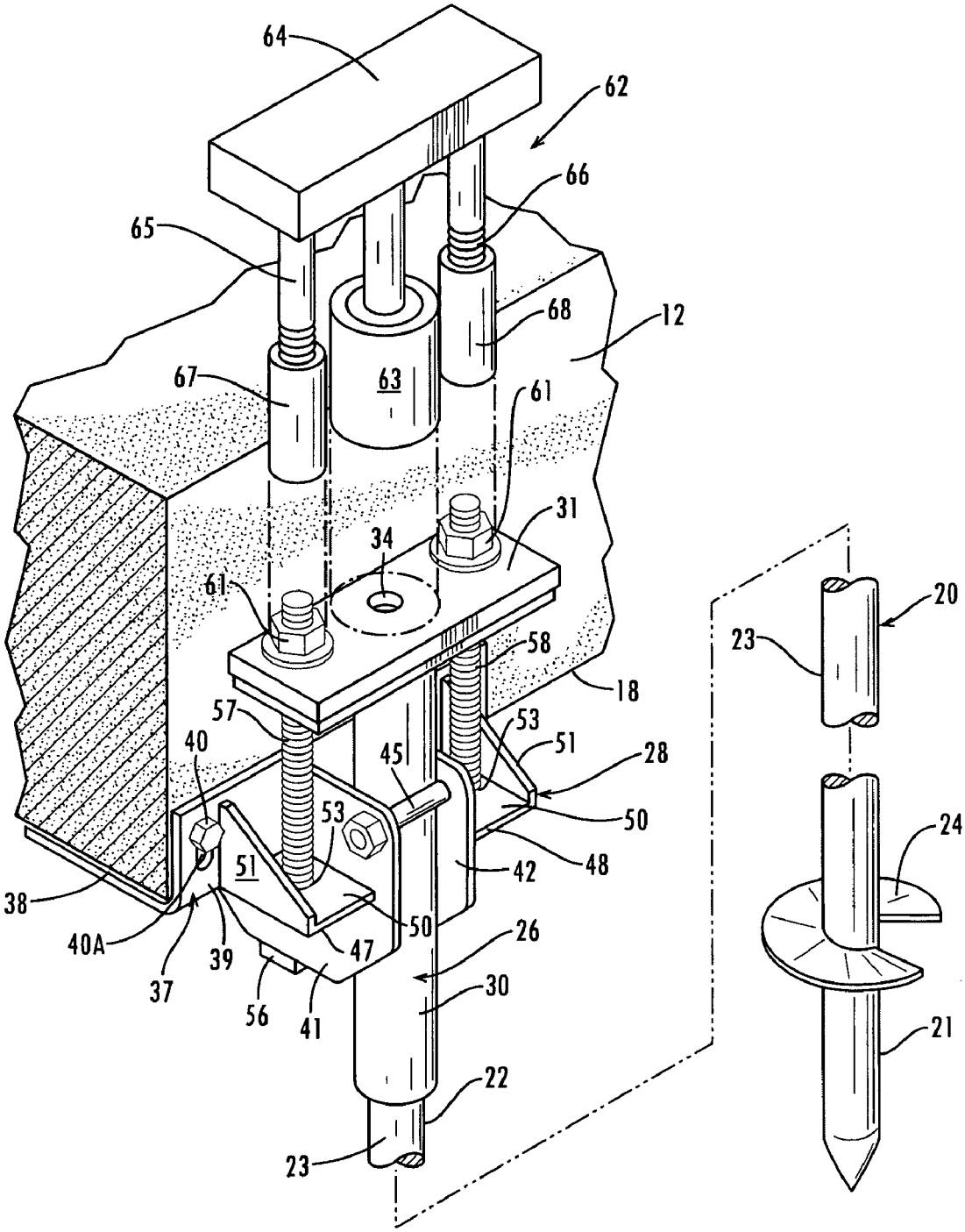
FIG. 2 is a perspective view of the stabilizing apparatus with the jacking tool assembly and its associated elements shown displaced from the apparatus.
Figure 3:
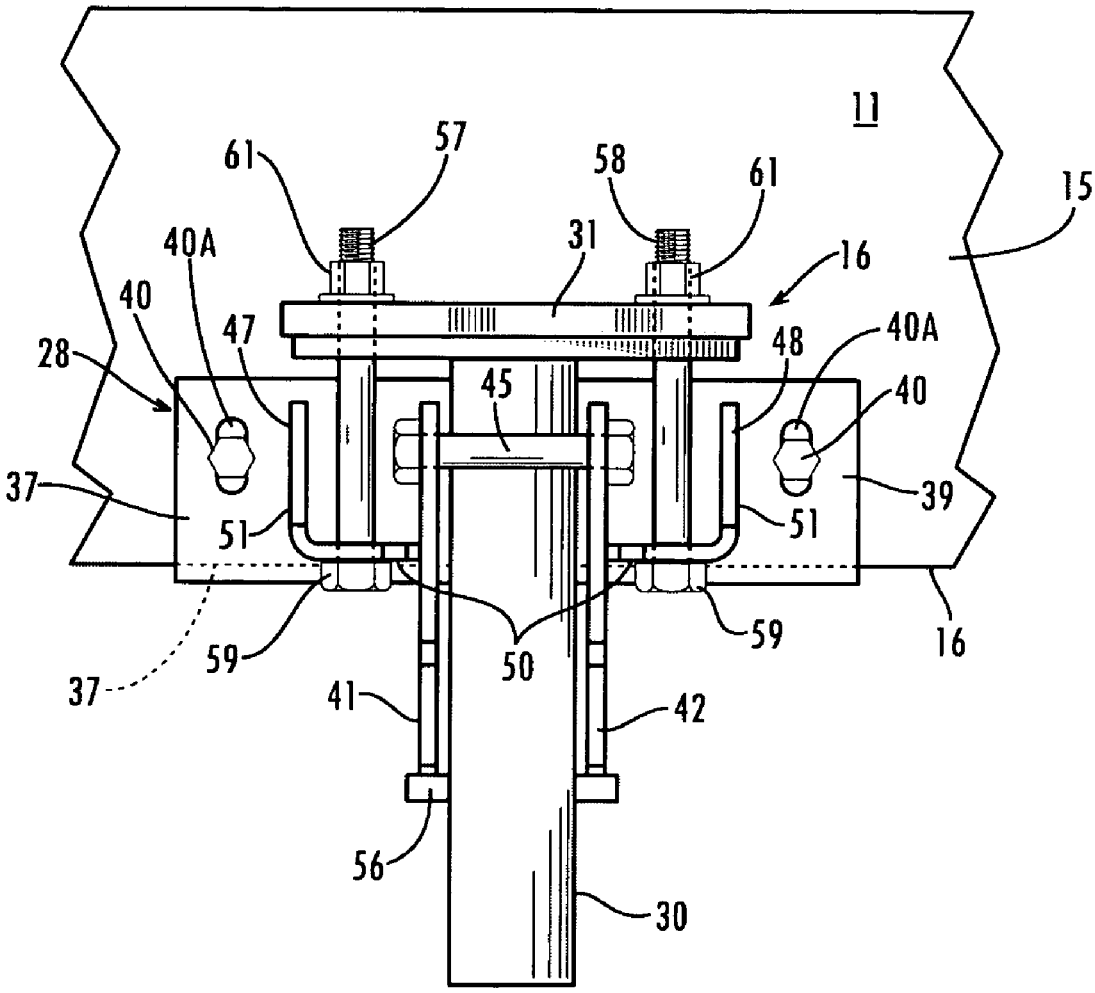
FIG. 3 is a rear view of the engaged stabilizing apparatus of FIGS. 1 and 2.

Parallel strengthening plates or gussets 41 and 42 are each formed with an L-shaped edge that engages the back and bottom surfaces of the L-shaped foundation engaging plate 37. The parallel gussets 41 and 42 define a space therebetween that corresponds to the diameter of the mounting sleeve 30 of the jack and pile bearing plate support 26, so that the mounting sleeve 30 can be received between the gussets 41 and 42, as shown in FIGS. 2 and 3. Aligned openings 43 and 44 are formed through the upper portions of the gussets 41 and 42, and a locking bolt 45 extends through the aligned openings 43 and 44 so as to lock the foundation-lifting bracket 28 in vertically sliding relationship with respect to the mounting sleeve 30 ofthe jack and pile bearing plate support 26.

A pair of inverted elevator brackets 47 and 48 are positioned outside of and in contact with gussets 41 and 42. The inverted elevator brackets are substantially mirror images of each other and each is L-shaped with a laterally extending bottom plate 50 affixed to the adjacent gusset and to the upper extending positioning flange 39 of the L-shaped foundation engaging plate 37, and an upwardly extending plate 51 mounted to the upwardly extending flange 39 of the L-shaped foundation engaging plate 37. The inverted elevator brackets 47 and 48 each form a U-shaped recess with the gussets 41 and 42 and the upwardly extending positioning flange 39. Lifting screw openings 53 are formed through the laterally extending plate 50. This places the lifting screw openings very low in the overall configuration of the foundation lifting bracket 28.

Cross bar 56 is connected at its ends to the lower edges of the gussets 41 and 42, extending across the space between the gussets. The cross bar is adapted to stabilize the lower edges of the gussets and also to bear against the mounting sleeve 30 ofjack and pile bearing plate support 26 in response to a weight being applied to the foundation-lifting bracket 28.

Lifting screws 57 and 58 are vertically oriented, with their upper end portions extending upwardly through the lifting screw openings 32 and 33 of the jack and pile bearing plate 31, and their lower end portions extending downwardly through the lifting screw openings 53 of each of the inverted elevator brackets 47 and 48. Connectors, such as nuts 61 are threadedly connected to the threads at the upper ends of the lifting screws, and bolt heads 59 or other connectors are positioned on the ends of the lifting screws below the inverted elevator brackets 47 and 48.

With the lifting screws 57 and 58 in place as shown in FIGS. 2 and 3, the tightening of the nuts 61 at the upper ends of the lifting screws against the jack and pile bearing plate 31 will draw the foundation-lifting bracket 28 upwardly toward the jack and pile bearing plate 31, applying a lifting force to the horizontal slab 12 of the structural foundation.

In order to more expediently lift the foundation-lifting bracket 28, a jacking tool assembly 62 is employed, as shown in FIG. 2. The jacking tool assembly includes a hydraulic jack 63 that is placed on the jack and pile bearing plate 31, and a horizontal jacking plate 64 is positioned over the jack. A pair of parallel vertically extending keeper bolts 65 and 66 are attached at their upper ends to the opposite ends ofjacking plate 64 and extend downwardly on opposite sides of the jack 63. Internally threaded coupling nuts 67 and 68 are threaded at their opposite ends to the threads of the lower ends of the parallel keeper bolts 65 and 66 and to the upper ends of the lifting screws 57 and 58. When the jack is operated to lift jacking plate 64, the jacking plate moves away from the jack and pile bearing plate 31, causing the parallel keeper bolts 65 and 66 and their internally threaded sockets 67 and 68 to lift the lifting screws 57 and 58, which causes the lifting screws to slide through the lifting screw openings 32 and 33 of the jack and pile bearing plate 31. The upward movement of the lifting screws draws the foundation-lifting bracket 28 upwardly about the mounting sleeve 30 of the jack and pile bearing plate support 26, thereby exerting an upward lifting force on the horizontal slab 12 of the structural foundation 11.

Once the foundation slab 11 has been stabilized by raising the foundation-lifting bracket with the jack and lifting screws, the nuts 61 of the lifting screws are rotated on the threads of the lifting screws to move down into engagement with the jack and pile bearing plate 31 to lock the foundation-lifting bracket in place. The jack 63 and its keeper bolts 65 and 66 and coupling nuts 67 and 68 are disconnected and removed from the foundation stabilizing apparatus 10. The excavation about the affixed foundation stabilizing apparatus is then backfilled with earth.

Operation

When the foundation stabilizing apparatus 10 is to be placed in use, an excavation 9 is formed at the edge of the structural foundation 11 for each foundation stabilizing apparatus, to expose the corner 18 of the foundation slab. The ground anchor 20 is positioned with its helical plate 24 in the excavation and is hydraulically rotated so as to cause the helical plate to draw the ground anchor down into the earth until a suitable support is founded for the ground anchor. If the upper portion of the shaft 23 of the ground anchor extends too high, it can be cut so as to provide the ground anchor to exist at the right height. The ground anchor is to function as a pier or a pile support.

The jack and pile bearing plate support 26 is connected to the ground anchor by telescoping the mounting sleeve 30 over the exposed upper portion of the ground anchor until the upper end of the ground anchor engages the jack and pile bearing plate 31.

The foundation-lifting bracket 28 is then mounted to the jack and pile bearing plate support 26 by placing the L-shaped foundation engaging plate 37 in engagement with the lower edge of the horizontal slab 12 and then placing the lock pin 45 through the aligned openings 43 and 44, behind the mounting sleeve 30. The lifting screws 57 and 58 are passed upwardly through the lifting screw openings 53 of the inverted elevator brackets 47 and 48 with the heads 59 or other connectors positioned below the inverted elevator brackets, and the threaded portions of the lifting screws extending upwardly through the lifting screw openings 32 and 33 of the jack and pile bearing plate 31. The nuts 61 are applied to the protruding ends of the lifting screws. This supports the foundation-lifting bracket 28 on the jack and pile bearing plate 31 in sliding relationship on the mounting sleeve 30 of the jack and pile bearing plate support 26.

The jack assembly 62 is then mounted to the jack and pile bearing plate support 26 by placing the jack 63 directly on the jack and pile bearing plate 31 and by connecting the internally threaded coupling nuts 67 and 68 to the upper ends of the threaded lifting screws. With the jacking tool assembly in place, the jack is then actuated, lifting the jacking plate 64 and its parallel keeper bolts 65 and 66 upwardly, thereby lifting the coupling nuts 67 and 68 upwardly to then lift the lifting screws 57 and 58 up through the lifting screw openings 32 and 33 of the jack and pile bearing plate 31. This causes the foundation-lifting bracket 28 to move upwardly, with the lifting screws passing through the openings of the jack and pile bearing plate 31.

As a result of the foundation-lifting bracket moving upwardly as described, the engagement of the foundation-lifting bracket 28 against the horizontal bottom surface 16 of the structural slab 12 causes the structural slab to bear the weight of the slab and to begin upward movement of the slab.

Once the desired upward movement of the slab has been achieved, the nuts 61 are tightened on the lifting screws downwardly toward engagement with the jack and pile bearing plate 31, locking the lifting screws in place. Then the jack assembly 62 is removed from the stabilizing apparatus and moved to another location and the procedure repeated.

In the meantime, the foundation stabilizing apparatus acquires a low profile in comparison to the height of the horizontal slab 12. It can be seen that as the slab is lifted, the jack and pile bearing plate 31 acquires downward relative movement with respect to the structural foundation so that the jack and pile bearing plate can acquire a position immediately above the gussets 41 and 42. If desired, the upper end portions of the lifting screws can be cut, thereby removing any extended portions of the assembly that protrude upwardly beyond the nuts 61 on the top of the jack and pile bearing plate 31. This is shown in FIG. 3 of the drawings. Preferably, the elevator screws will remain long enough so that at least a small number of its threads remain above the nuts 61 for re-connection of the jack assembly to the apparatus for re-adjustment of the slab.

Figure 6:
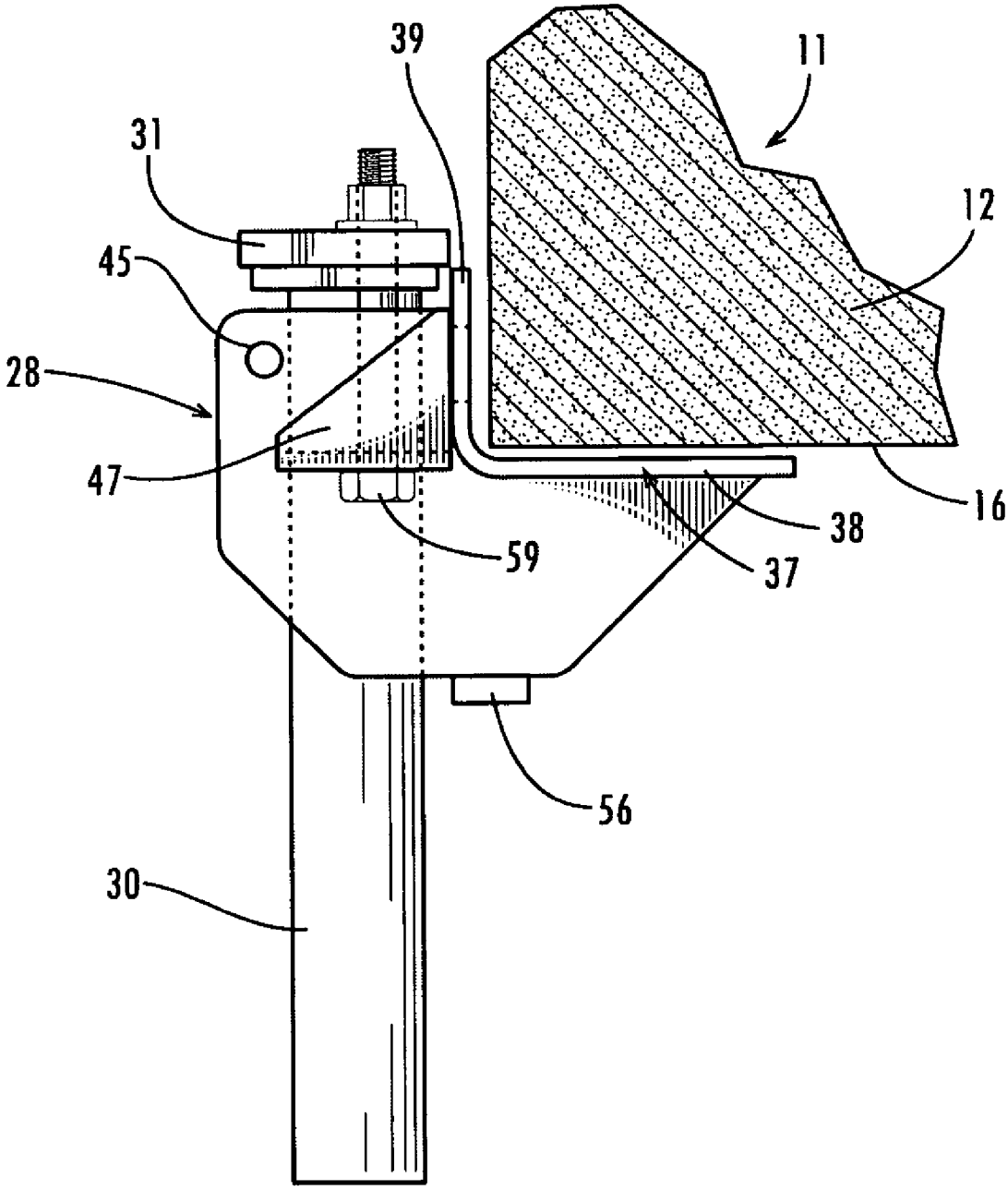
FIG. 6 is a side elevational view of the mounting bracket of FIG. 5, mounted on the jacking tool assembly of FIG. 4.

As shown in FIGS. 2, 4 and 6, jack and pile bearing plate 31 and its lifting screw openings 32 are positioned adjacent and above the foundation-lifting bracket 28. Likewise, the lifting screw openings 53 of inverted elevator brackets are located adjacent the foundation-lifting bracket 28. This applies the lifting force of the lifting screws 57 and 58 closely adjacent the foundation-lifting bracket 28 so as to more effectively balance the load on the apparatus. Also, the cross bar 56 at the lower edges of the gussets 41 and 42 is positioned so as to engage against the mounting sleeve 30 of the jack and pile bearing plate support 26, thereby avoiding any twisting of the foundation-lifting bracket 28 away from right angle engagement with respect to the right angle surfaces of the vertical side surface 15 and horizontal bottom surface 16 of the horizontal slab 12.

The placement of the oblong connector openings laterally of the inverted elevator brackets instead of over the inverted elevator brackets allows the height of the upwardly extending positioning flange to be shorter and therefore avoids its having a high profile and avoids its protruding upwardly adjacent the slab. Also, in the inverted elevator brackets 47 and 48 the location of the laterally extending plates 50 that have the lifting screw openings 53 at a low position provides a longer stroke of the elevator screws and more range of lifting of the foundation lifting bracket 28.

Although a preferred embodiment of the invention has been disclosed in detail herein, it will be obvious to those skilled in the art that variations and modifications of the disclosed embodiment can be made without departing from the spirit and scope of the invention as set forth in the following claims.

The invention claimed is:

1. An apparatus for stabilizing the structural foundation of a building having a concrete slab, comprising:

an elongated screw anchor including a shaft with a lower end and an upper end and auger threads extending from said lower end for screwing into the earth with the upper end exposed at the level of the earth, jacking tool assembly including a mounting sleeve telescopically mounted on the upper end of said shaft of said screw anchor and a jack and pile bearing plate connected to said mounting sleeve for abutting the upper end of said shaft of said screw anchor, lifting screw openings formed in said jack and pile bearing plate on opposite sides of said mounting sleeve, a foundation-lifting bracket positioned below said jack platform including an L-shaped foundation engaging plate having a laterally extending support flange for engaging beneath the lower edge of a foundation and an upwardly extending positioning flange for engaging against the side of the foundation, parallel strengthening plates mounted to said laterally extending support flange and said upwardly extending positioning flange of said L-shaped foundation engaging plate for straddling said mounting sleeve, a pair of inverted elevator brackets mounted on opposite sides of said parallel strengthening plates, each inverted elevator bracket being L-shaped with a laterally extending plate mounted to said upwardly extending flange of said L-shaped foundation engaging plate and to one of said parallel strengthening plates, and an upwardly extending plate mounted to said upwardly extending flange of said L-shaped foundation engaging plate, and forming with said parallel strengthening plates and said L-shaped foundation engaging plate a pair of laterally spaced U-shaped receptacles, and a lifting screw opening formed in said laterally extending plate of each said inverted elevator brackets, connector openings formed in said upwardly extending positioning flange of said L-shaped foundation engaging plate positioned laterally of said inverted elevator brackets such that keeper bolts can be extended through said upwardly extending positioning flange of said L-shaped foundation engaging plate and into the foundation for connecting the L-shaped foundation engaging plate to the foundation, and lifting screws extending vertically through said lifting screw openings of said inverted elevator brackets and through said lifting screw openings of said jack and pile bearing plate, and connectors mounted to the ends of said lifting screws for suspending said foundation-lifting bracket from said jacking tool assembly.

2. An apparatus for stabilizing the structural foundation of a building having a concrete slab, comprising:

a bearing plate configured for mounting on the upper end of a pile, lifting screw openings formed in said bearing plate, a foundation-lifting bracket positioned below said jack platform including an L-shaped foundation engaging plate having a laterally extending support flange for engaging beneath the lower edge of a foundation and an upwardly extending positioning flange of a height less than the height of the structural foundation for engaging against the side of the foundation, a pair of elevator brackets mounted to said upwardly extending flange of said L-shaped foundation engaging plate, each elevator bracket having a laterally extending plate defining a lifting screw opening formed therein, said laterally extending plate positioned on said upwardly extending positioning flange at less than one-third the height of said upwardly extending positioning flange, connector openings formed in said upwardly extending positioning flange of said L-shaped foundation engaging plate positioned laterally of said inverted elevator brackets such that connectors can be extended through said upwardly extending positioning flange of said L-shaped foundation engaging plate and into the foundation for connecting the L-shaped foundation engaging plate to the foundation, lifting screws extending vertically through said lifting screw openings of said elevator brackets and through said lifting screw openings of said bearing plate, and connectors mounted to the ends of said lifting screws for suspending said foundation-lifting bracket from said jacking tool assembly.

3. The apparatus of claim 2, wherein said elevator brackets are L-shaped.

4. The apparatus of claim 2, wherein said connector openings formed in said upwardly extending positioning flange of said L-shaped foundation engaging plate are oval-shaped.

5. Apparatus for stabilizing the structural foundation of a building having a concrete slab having a vertical side surface and a horizontal bottom surface, comprising:

a bearing plate for mounting on a pile, a foundation lifting bracket positioned below said bearing plate including a laterally extending support flange for placement beneath the bottom surface of the concrete slab and an upwardly extending positioning flange for connection to the side surface of the concrete slab, elevator means resting on said bearing plate for lifting said foundation lifting bracket with respect to said bearing plate, and said foundation lifting bracket configured such that said upwardly extending positioning flange of said foundation lifting bracket cannot exceed the height of said bearing plate when said foundation lifting bracket is raised by said elevator means.

6. A method of stabilizing a foundation support slab comprising, placing a support pile in the earth adjacent the support slab, mounting a bearing plate on the upper end of the support pile, suspending a foundation lifting bracket from said bearing plate with a laterally extending support flange positioned beneath the foundation support slab and an upwardly extending positioning flange positioned adjacent the slab, connecting the upwardly extending flange to the foundation support slab, elevating the foundation lifting bracket with respect to the bearing plate, as the foundation lifting bracket is elevated, engaging the foundation lifting bracket against the bearing plate before the upwardly extending support bracket exceeds the height of the bearing plate.

* * * * *